US005889450A

United States Patent [19]

Kim et al.

[11] Patent Number: 5,889,450

[45] Date of Patent: Mar. 30, 1999

[54] CURRENT TRANSFORMER ASSEMBLY FOR ELECTRONIC CIRCUIT INTERRUPTERS

[75] Inventors: Edward E. Kim, Burlington; Joseph B. Kelaita, Jr., Bristol; Raymond K. Seymour, Plainville; John J. Bottalico, Newington, all of Conn.

[73] Assignee: General Electric Company, Schenectady, N.Y.

[21] Appl. No.: 738,388

[22] Filed: Oct. 25, 1996

[51] Int. Cl.[6] ..... H01H 73/00

[52] U.S. Cl. ..... 355/18; 336/174

[58] Field of Search ..... 335/18; 361/42–49; 336/173, 174, 145–147, 90, 98

[56] References Cited

U.S. PATENT DOCUMENTS

| | | | |
|---|---|---|---|
| 3,846,675 | 11/1974 | Shimp . | |
| 4,297,741 | 10/1981 | Howell . | |
| 4,591,942 | 5/1986 | Willard et al. . | |
| 4,672,501 | 6/1987 | Bilac et al. . | |
| 4,796,148 | 1/1989 | Ruta . | |
| 4,937,757 | 6/1990 | Dougherty . | |
| 5,198,790 | 3/1993 | Elow | 336/83 |
| 5,204,798 | 4/1993 | Scott . | |
| 5,214,403 | 5/1993 | Bogaerts et al. | 336/84 C |
| 5,302,786 | 4/1994 | Rosen et al. . | |
| 5,307,040 | 4/1994 | Lytollis | 336/73 |
| 5,321,378 | 6/1994 | Ferullo . | |
| 5,446,431 | 8/1995 | Leach et al. | 335/18 |
| 5,559,486 | 9/1996 | Ilenoue et al. | 336/90 |

*Primary Examiner*—Lincoln Donovan
*Attorney, Agent, or Firm*—Fishman, Dionne, Cantor & Colburn; Carl B. Horton

[57] ABSTRACT

A circuit interrupter employing an electronic trip unit utilizes a current transformer assembly containing both air and metal cores on a common load strap for providing sensing current to the electronic trip unit along with supplying operating power to the trip unit electronic components. A two-part plastic housing provides support for the metal core and the sensing coil while further providing thermal transfer of heat generated within the transformer secondary windings out to the load strap.

24 Claims, 5 Drawing Sheets

CURRENT TRANSFORMER ASSEMBLY FOR ELECTRONIC CIRCUIT INTERRUPTERS

BACKGROUND OF THE INVENTION

The advent of digital circuit implementation to the electrical distribution and control field has resulted in combining several electronic functions within a single modular enclosure. One example of a circuit interrupter having supplemental protective relay function is found in U.S. Pat. No. 4,672,501 entitled "Circuit Breaker and Protective Relay Unit".

To provide a continuous sample of the current level within an associated electrical distribution system, a current transformer is connected within the circuit interrupter, as described within U.S. Pat. Nos. 4,591,942 and 5,321,378 both entitled "Current Transformer Assembly". The current transformers as employed therein also derive operating power from the circuit current to power-up the electronic components within the circuit interrupter electronic trip unit. It has been found advantageous to use a single iron core current transformer to both sense the circuit current along with providing operational power to the electronic trip unit in higher ampere-rated circuit interrupters. To prevent the iron cores from becoming saturated at higher current levels, expensive magnetic steel laminates are used and the laminates are sized to allow short circuit current sensing without causing the cores to saturate.

U.S. Pat. No. 4,796,148 entitled "Current-Sensing Arrangement Utilizing Two Current-Sensing Signals" teaches the use of a separate air core transformer and a separate iron core transformer to increase the current sensing range when the iron core saturates.

U.S. Pat. No. 4,297,741 entitled "Rate Sensing Instantaneous Trip Mode Network" describes the use of an iron core transformer for sensing ordinary current overload levels along with a separate air core transformer to sense short circuit currents.

U.S. Pat. No. 3,846,675 entitled "Molded Case Circuit Breakers Utilizing Saturating Current Transformers" teaches the use of iron core transformers for providing operating power to the trip unit and separate air core transformers for monitoring the circuit current.

In lower ampere-rated electronic circuit interrupters, the current transformer size constraints require the use of expensive core steel laminations to optimize transformer action with the least possible amount of material without reaching saturation when such current transformers are used for both sensing circuit current as well as powering up the electronic trip unit circuit. It would be economically desirable to perform such sensing and power-up functions by use of a single modular transformer design for all the reasons given earlier. One such modular design is described within U.S. patent application Ser. No. 08/358,493 filed 19 Dec. 1994 entitled "Modular Current Transformer for Electronic Circuit Interrupters" wherein separate iron core and air core transformers are used to sense circuit current within a protected circuit while providing operating power to the circuit interrupter electronic trip unit. U.S. patent application Ser. No. 08/735,719 entitled "Self Powered Axial Current Sensor" filed on 23 Oct. 1996 describes a compact current transformer arrangement wherein the current sensor coil is arranged within the transformer core and the power generating coil is arranged outside the transformer core. U.S. Pat. No. 5,774,320 entitled "Modular Current Transformer for Electronic Circuit Interrupters" describes a concentric arrangement of an air core transformer within an iron core transformer for providing current sampling to an electronic trip unit along with operating power. Tile advent of such compact and inexpensive current transformers now allows the use of circuit interrupters within lower ampere commercial and industrial environments.

One purpose of the invention is to provide a compact circuit interrupter employing an electronic trip unit whereby the operating power to the trip unit is provided by means of an iron core and the current sensing is provided by means of an air core both within a compact common current transformer assembly.

A further purpose of the invention is to provide means for reducing the operating temperature of the current transformer to allow compact insertion within smaller frame circuit breakers without overheating.

SUMMARY OF THE INVENTION

A circuit interrupter employing an electronic trip unit utilizes a modular current transformer containing both air and metal cores on a common load strap for providing sensing current to the electronic trip unit within the circuit interrupter along with supplying operating power to the trip unit electronic components. The current transformer sensor coil is arranged within the metal core and the power generating coil is arranged outside the metal core on a common axis. A two-part plastic housing provides support for the metal core and the sensing coil while further providing thermal transfer of heat generated within the metal core out to the circuit breaker load strap.

DESCRIPTION OF THE PREFERRED EMBODIMENT

Figure 1:
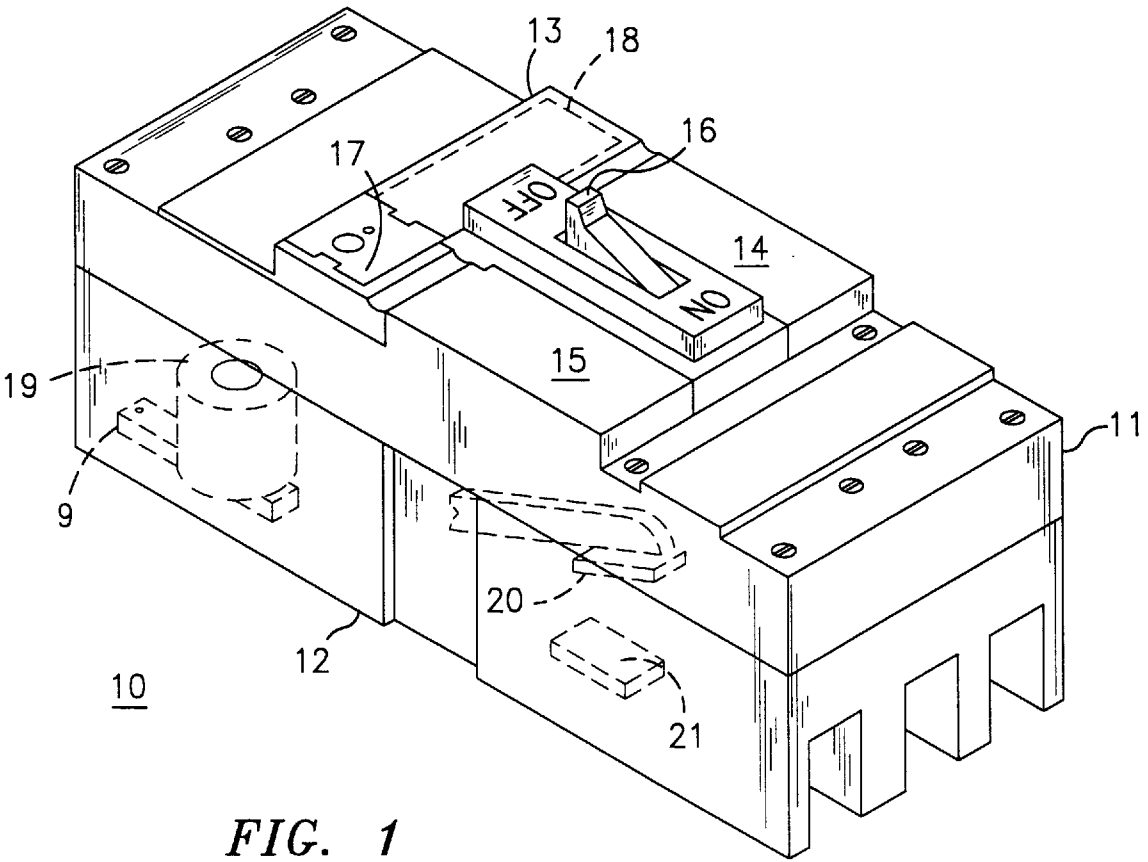
FIG. 1 is a top perspective view of a lower ampere-rated circuit interrupter containing the current transformer assembly according to the invention.

A circuit interrupter 10 of the type consisting of a molded plastic cover 11 secured to a molded plastic case 12 is shown in FIG. 1. The provision of an accessory cover 13 and accessory doors 14, 15 allows field as well as factory installed electric accessories such as described in U.S. Pat.

Figure 2:
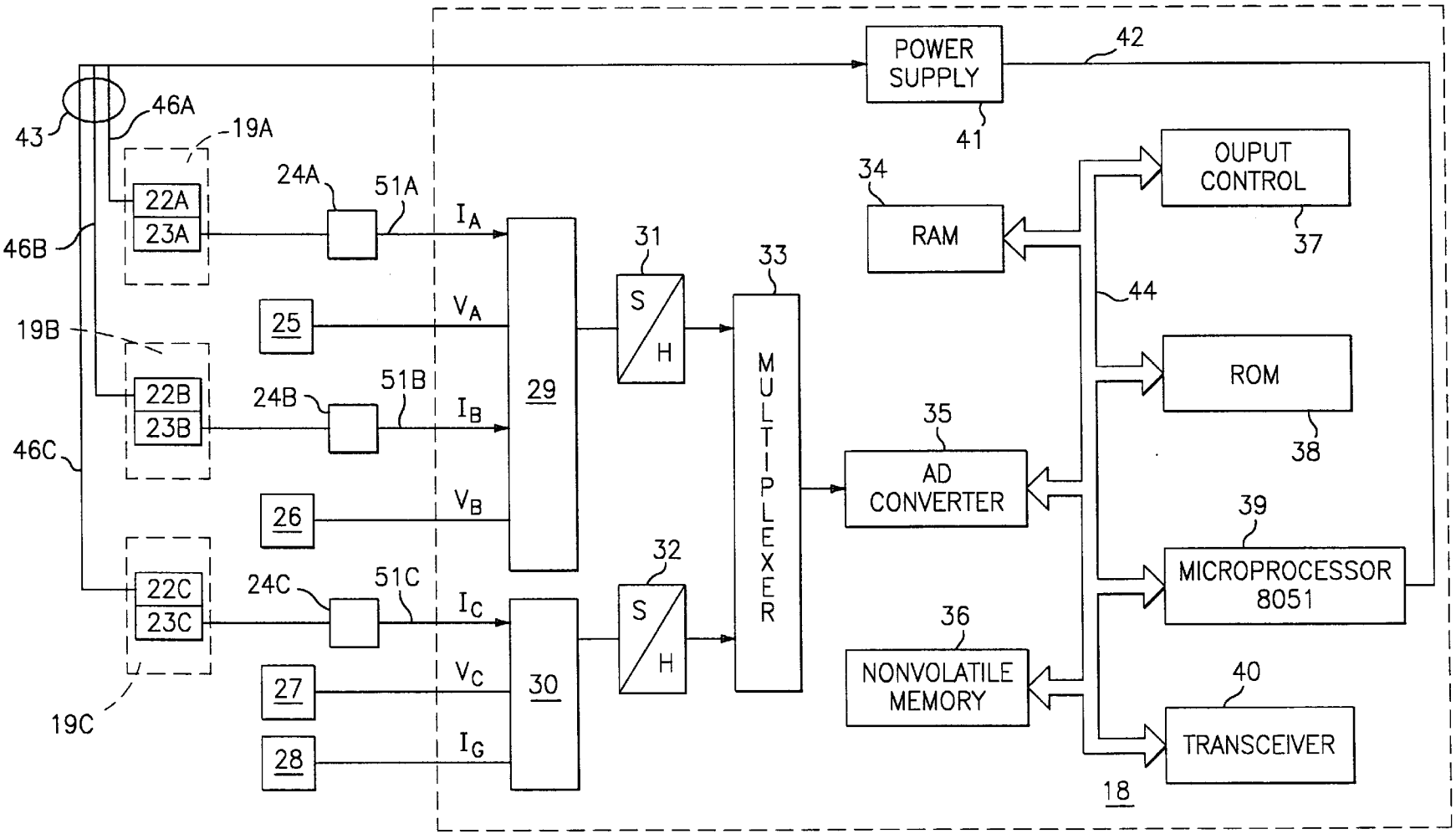
FIG. 2 is a diagrammatic representation of the circuit components used with the electronic trip unit within the circuit interrupter of FIG. 1.

No. 5,302,786 entitled "Circuit Interrupter With Remote Control". An externally-accessible operating handle 16 controls the open and closed conditions of the movable contact 20, and fixed contact 21 located within the case to allow and interrupt current flow through an associated electrical distribution circuit. Automatic circuit protection against overload circuit conditions is provided by means of an electronic trip unit 18 located within the circuit interrupter cover such as described within U.S. Pat. No. 4,937,757 entitled "Digital Circuit Interrupter with Selectable Trip Parameters". A rating plug 17 allows the circuit interruption rating to be set by externally accessing the electronic trip unit as described within U.S. Pat. No. 5,204,798 entitled "Metering Accessory for Molded Case Circuit Breakers". Connection with an external electrical distribution circuit is made by means of the load strap 9 that extends within the modular current transformer 19 which will be described below in greater detail. The operation of the trip unit 18 is best seen by now referring to FIG. 2.

Three such modular current transformers 19A–19C, one for each phase of a multiphase electrical distribution system are used to provide both operating power as well as current sampling to the electronic trip unit 18. The so-called "power windings" 22A–22C connect with the power supply 41 by means of a multi-conductor cable 43 and conductor pairs 46A–46C to provide operating power to the trip unit 18 and power-up the microprocessor 39 over conductor 42. Current sensing of the associated electrical distribution circuit is made by means of the so-called "sensor windings" 23A–23C that provide three phase sample signals connected to integrators 24A–24C to provide current signals IA, IB, IC through conductor pairs 51A–51C to multiplexers 29, 30 and sample and hold amplifiers 31, 32 to the multiplexer 33. At the same time, sample voltages VA, VB, VC are provided by means of the voltage transformers 25–27 and ground fault samples IG are provided by means of the ground fault current transformer 28. The sample current and voltage data is inputted to a databus 44 through the A/D converter 35. The data is processed within the microprocessor 39 under operating instructions contained within the ROM 38 and stored reference values contained within the RAM 34 and NVM 36. Control signals are outputted via the output control circuit 37 to interrupt the circuit current when the overcurrent condition exists for longer than a prescribed time increment. Information to related circuit interrupters and accessory electrical devices is transmitted by means of the transceiver 40.

Figure 3:
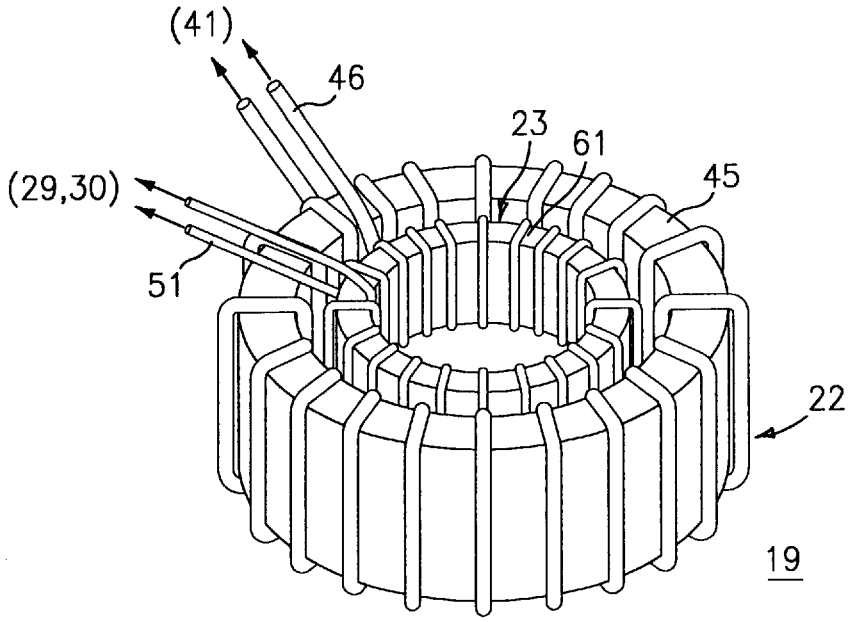
FIG. 3 (PRIOR ART)
FIG. 3 is an enlarged top perspective view of an air core-iron core current transformer according to the prior art.

Before describing the current transformer assembly of the invention, it is helpful to review the modular current transformer 19 (shown in FIG. 3), similar to the self-powered axial current sensor described within aforementioned U.S. patent application Ser. No. 08/735,719 . The sensor winding 23 terminating in the pair of wire conductors 51 which connect with the multiplexers 29, 30 within the trip unit 18 of FIG. 1 is arranged about a plastic cylindrical mandrel 61 and is inserted within an iron core 45 about which the power winding 22 terminating in the pair of conductors 46 which connect with the power supply 41 within the trip unit 18 of FIG. 1 is arranged. The sensor winding 23 serves as an air core transformer which has a greater sensitivity to differential current changes within the protected circuit and does not exhibit saturation limitation effects that would occur at higher currents when iron cores are used. The power winding 22 now serves as an iron core transformer which requires less iron with partial saturation of the core to provide sufficient operating power to the trip unit 18 of FIGS. 1 and 2, and hence can be made more compact since substantially less iron is required to produce power.

Figure 4:
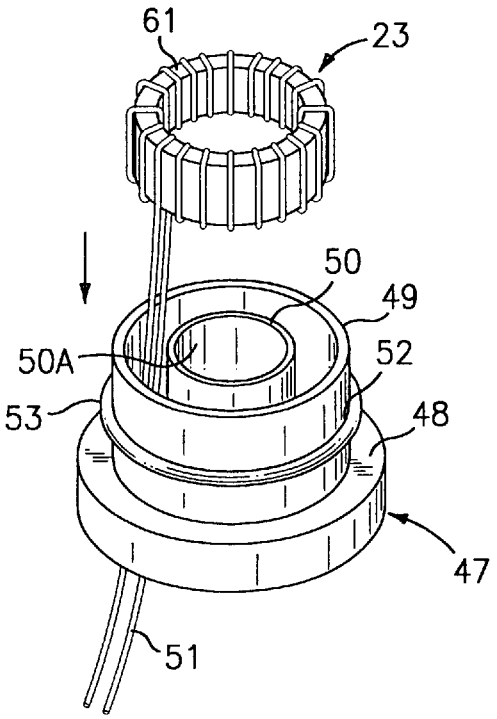
FIG. 4 is a top perspective view of the cover portion of the current transformer assembly of the invention with the air core transformer in isometric projection.
Figure 5:
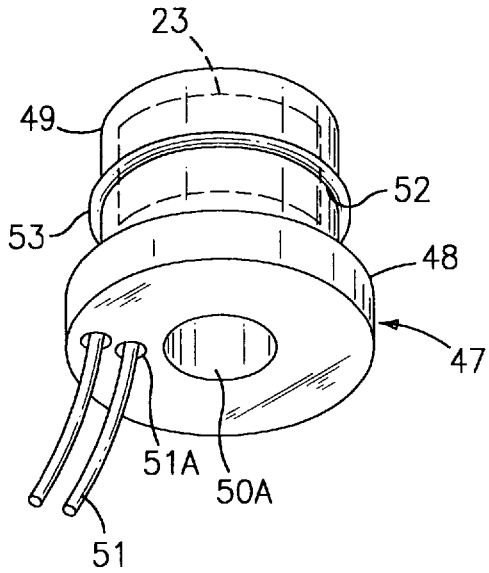
FIG. 5 is an enlarged front perspective view of the cover portion of FIG. 3 after assembly.
Figure 8:
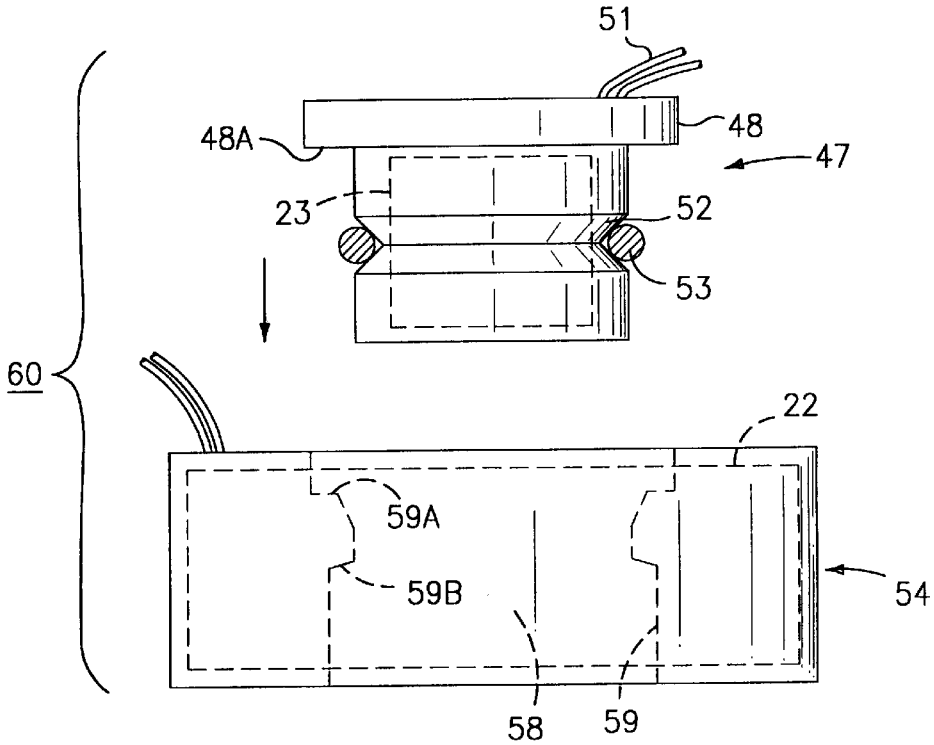
FIG. 8 is an enlarged top perspective view of the case portion of FIG. 5 in isometric projection relative to the case portion of FIG. 7.
Figure 9:
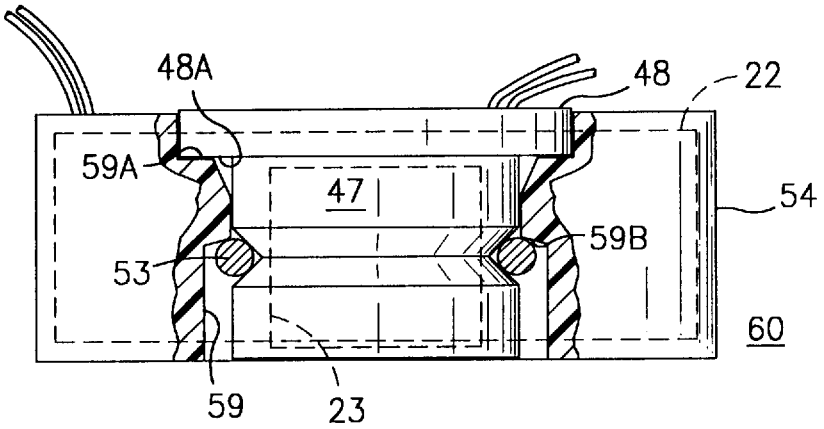
FIG. 9 is an enlarged side view of the current transformer assembly according to the invention, in partial section.
Figure 10:
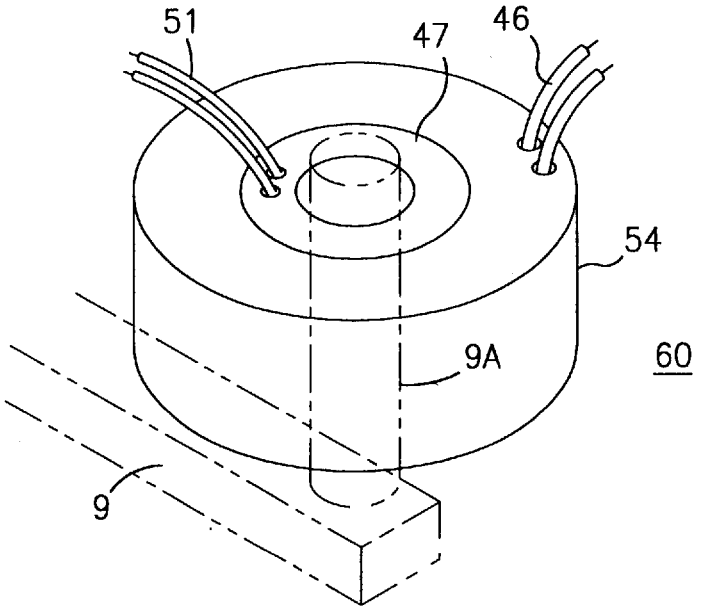
FIG. 10 is a top perspective view of the complete current transformer assembly according to the invention.

The current transformer assembly according to the invention is best seen by referring to FIGS. 4–10. In FIGS. 4 and 5, the sensor winding 23, plastic mandrel 61, and wire conductors 51 are positioned within a plastic cover 47 between an inner cylinder 50 and an outer cylinder 49 integrally-formed therein. The passage 50A through the inner cylinder 50 allows for the passage of the primary winding for the purposes described within the aforementioned U.S. patent application Docket No. 08/735,719. A peripheral groove 52 is formed within the outer surface of the outer cylinder 49 and an oversized ring 53 is positioned within the groove for the purpose to be described below. A perimetric base 48 is formed at the bottom of the outer cylinder 49 for assisting in the attachment between the cover 47 and the case 54 shown in FIG. 7. The wire conductors exit the cover through apertures 51 A and the passage 50A extends through the base to access the primary winding consisting of the load strap connector 9A (FIG. 10).

Figure 6:
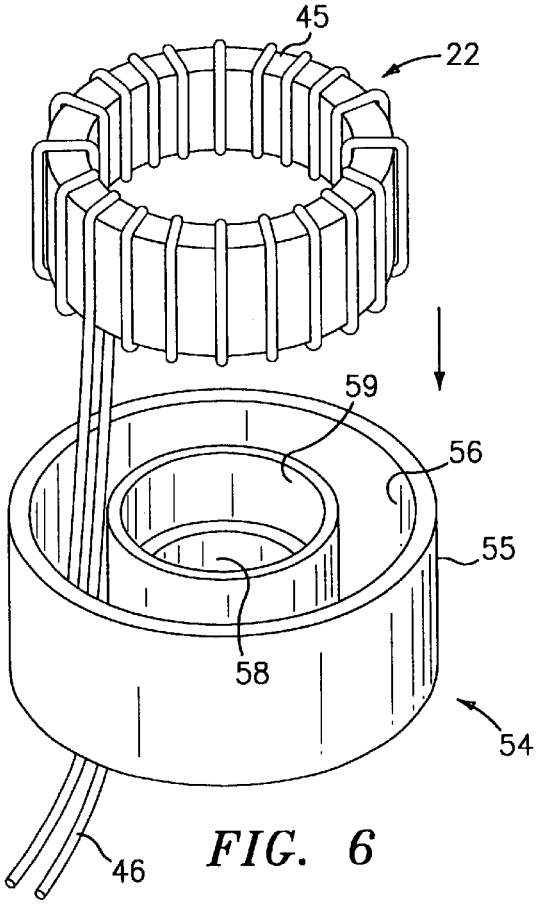
FIG. 6 is a top perspective view of the case portion of the current transformer assembly of the invention with the iron core transformer in isometric projection.
Figure 7:
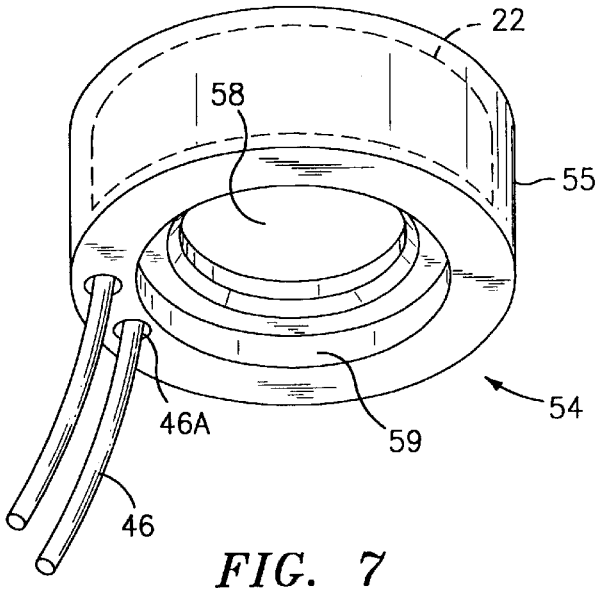
FIG. 7 is an enlarged front perspective view of the case portion of FIG. 6 after assembly.

In FIGS. 6 and 7, the power winding 22, iron core 45, and wire conductors 46 are positioned within tile case 54 between the inner cylinder 56 and outer cylinder 55. The large cylindrical passage 58 defined within the inner cylinder facilitates insertion of the primary winding 9A as described earlier. The inner collar integrally-formed on the inner surface of the inner cylinder assists in attaching the cover 47 of FIG. 5 within the case 54 in the manner to be described with reference now to FIGS. 8 and 9.

The cover 47 containing the sensor winding 23, wire conductors 51 and ring 53 within the groove 52 is positioned over the case 54 and axially aligned within the cylindrical passage 58. Upon insertion of the cover within the passage, the bottom rim 48A of the base 48 stops against the top 59A of the inner collar 59. The ring 53 first compresses within the groove 52 and then expands outwards under the bottom 59B of the inner collar 59 to lockingly retain the cover within the case and to exactly align the sensor winding 23 within power winding 22.

The current transformer assembly 60 which includes the cover 47 and case 54 is shown in FIGS. 8, 9 and 10. The positioning of the sensor winding 23 within the power winding 22 is accurately set by means of the engagement of tile ring 53 on the cover 47 under the bottom 59B of the inner collar 59 on the case 54 and by the supporting of the bottom rim 48A of the base 48 on the top 59A of the inner collar 59. The wire conductors 46, 51 are thereby positioned to exit from the same end of the current transformer assembly. The heat generated within the windings 22, 23 is carried outwards by thermal transport through the electrically resistant-thermally conductive plastic material used to fabricate the cover 47 and case 54 out to the load strap connection which serves as the primary winding as indicated in phantom at 9A in FIG. 10 as a metal bar connecting with the circuit breaker load strap 9, also indicated in phantom.

A current transformer assembly having the capability of providing rapid power-up to the electrical components within and electronic trip unit along with extended current sensing without saturation has herein been described. The thermal transport properties of the enclosure assembly provides heat sink facility to the transformer secondary windings.

We claim:

1. A current transformer assembly comprising:

a case having an inner case cylinder defining a first aperture extending therethrough;

a first transformer winding arranged within said case concentric with said first aperture;

a cover having an outer cover cylinder and a second aperture extending therethrough, wherein the outer cover cylinder is disposed within the inner case cylinder; and a second transformer winding arranged within said cover concentric with said second aperture;

whereby said first and second transformer windings are concentric with each other and with said first and second apertures.

2. The current transformer assembly of claim 1 wherein said first transformer winding is arranged around a non-metallic bobbin.

3. The current transformer assembly of claim 1 wherein said second transformer winding is arranged around a metal core.

4. The current transformer assembly of claim 1 wherein said case and said cover comprise plastic.

5. The current transforner assembly of claim 1 wherein said case includes a collar arranged on an inner surface thereof.

6. The current transformer assembly of claim 5 wherein said cover includes a base, said base being supported on a top part of said collar.

7. The current transformer assembly of claim 1 wherein said cover further comprises an inner cover cylinder, said first transformer winding being arranged intermediate said inner cover cylinder and said outer cover cylinder.

8. The current transformer assembly of claim 1 wherein said case comprises an inner case cylinder and an outer case cylinder, said second transformer winding being arranged intermediate said inner case cylinder and said outer case cylinder.

9. The current transformer assembly of claim 8 further comprising:

a locking ring:

wherein said inner cover cylinder includes a perimetric groove along an outer surface for receiving said locking ring.

10. The current transformer assembly of claim 9 wherein said inner case cylinder includes a collar formed within an inner surface.

11. The current transformer assembly of claim 10 wherein said locking ring seats beneath a part of said collar to retain said cover within said case.

12. A circuit breaker comprising:

a plastic case and a plastic cover;

a pair of separable contacts within said case and arranged for separation upon occurrence of an overcurrent condition in a protected electrical circuit;

an electronic trip unit in said cover controlling said separable contacts and determining said over current condition;

a transformer assembly within said case electrically connected with said trip unit and electromagnetically coupled with a metal strap, said transformer assembly comprising:

a case having an inner case cylinder defining a first aperture extending therethrough;

a first transformer winding arranged within said case concentric with said first aperture;

a cover having an outer cover cylinder and a second aperture extending therethrough, wherein the outer cover cylinder is disposed within the inner case cylinder; and a second transformer winding arranged within said cover concentric with said second aperture;

whereby said first and second transformer windings are concentric with each other and with said first and second apertures.

13. The circuit breaker of claim 12 wherein said first transformer winding is arranged around a non-metallic bobbin.

14. The circuit breaker of claim 12 wherein said second transformer winding is arranged around a metal core.

15. The circuit breaker of claim 12 wherein said case and said cover comprise plastic.

16. The circuit breaker of claim 12 wherein said case includes a collar arranged on an inner surface thereof.

17. The circuit breaker of claim 16 wherein said cover includes a base, said base being supported on a top part of said collar.

18. The circuit breaker of claim 12 wherein said cover comprises an inner cover cylinder and an outer cover cylinder, said first transformer winding being arranged intermediate said inner cover cylinder and said outer cover cylinder.

19. The circuit breaker of claim 12 wherein said case comprises an inner case cylinder and an outer case cylinder, said second transformer winding being arranged intermediate said inner case cylinder and said outer case cylinder.

20. The current transformer assembly of claim 19 further comprising:

a locking ring;

wherein said inner cover cylinder includes a perimetric groove along an outer surface for receiving said locking ring.

21. The circuit breaker of claim 20 wherein said inner case cylinder includes a collar formed within an inner surface.

22. The circuit breaker of claim 21 wherein said locking ring seats beneath a part of said collar to retain said cover within said case.

23. A current transformer assembly comprising:

a case having an inner case cylinder defining a first aperture extending therethrough;

a first transformer winding arranged within said case concentric with said first aperture;

a cover having an outer cover cylinder and a second aperture extending therethrough, wherein the outer cover cylinder is disposed within the inner case cylinder; and a second transformer winding arranged within said cover concentric with said second aperture;

whereby said first and second transformer windings are concentric with each other and with said first and second apertures and said cover interlocks with said case.

24. The current transformer assembly of claim 23 wherein said cover further comprises an inner cover cylinder having a perimetric groove along an outer surface for receiving a locking ring and said inner case cylinder includes a collar formed within an inner surface, wherein said locking ring seats beneath a part of said collar to retain said cover within said case.

* * * * *